US006725608B1

(12) United States Patent
Kraus

(10) Patent No.: US 6,725,608 B1
(45) Date of Patent: Apr. 27, 2004

(54) GARAGE OVERHEAD STORAGE ASSEMBLY

(76) Inventor: Harlen L. Kraus, P.O. Box 44, Colwich, KS (US) 67030

( * ) Notice: Subject to any disclaimer, the term of this patent is extended or adjusted under 35 U.S.C. 154(b) by 68 days.

(21) Appl. No.: 10/244,764

(22) Filed: Sep. 16, 2002

(51) Int. Cl.[7] ..... E04F 19/00
(52) U.S. Cl. ..... 52/36.4; 52/22; 52/506.06
(58) Field of Search ..... 52/36.4, 22, 506.06, 52/508, 506.01, 506.05; 108/57.17, 57.23, 51.11, 57.2; 211/113, 119.003; 248/214, 343

(56) References Cited

U.S. PATENT DOCUMENTS 5,199,843 A * 4/1993 Sferra ..... 414/592
6,311,626 B1 * 11/2001 Roberts ..... 108/42
6,439,405 B1 * 8/2002 Hanneken ..... 211/113

FOREIGN PATENT DOCUMENTS

GB 2045600 * 11/1980 ..... 52/36.4

* cited by examiner

*Primary Examiner*—Carl D. Friedman
*Assistant Examiner*—Naoko Slack
(74) *Attorney, Agent, or Firm*—Kenneth H. Jack; Davis & Jack, LLC

(57) ABSTRACT

A storage assembly consisting of a storage space below a garage ceiling with rafters and a ceiling panel and above an opened overhead garage door, the ceiling panel having tie receiving apertures, a plurality of ceiling catching beams extending perpendicularly over the rafters, a plurality of metal ties extending through the ceiling panel apertures and catching beam apertures, a plurality of fasteners fixedly attached to the upper ends of the ties, securing the ties to the ceiling catching beams, the lower ends of the ties extending through apertures in a plurality of shelf catching beams, fasteners attached to the lower ends of the ties, and a shelf panel overlying the shelf catching beams, wherein the lower ends of the ties overly the opened overhead garage door.

12 Claims, 2 Drawing Sheets

GARAGE OVERHEAD STORAGE ASSEMBLY

FIELD OF THE INVENTION

This invention relates to apparatus and articles adapted for shelf storage, and to garages having overhead garage doors.

BACKGROUND OF THE INVENTION

Articles such as wooden poles, wooden boards, and long handled hand tools are commonly stored standing on end and tilted into a corner of a common residential garage. Such storage method undesirably tends to cause the boards and poles to warp, and undesirably takes up garage floor space. As a suitable alternate, shelves for storage of such items may be mounted upon the walls of a residential garage. However, wall mounted shelves undesirably encroach laterally into the useful automobile parking space of the garage.

The instant inventive garage overhead storage assembly solves or ameliorates the garage storage space problems and deficiencies noted above by providing an economically constructed and mechanically simple shelf assembly, which unobtrusively occupies unused overhead space between a garage's ceiling and a garage's opened overhead garage door.

BRIEF SUMMARY OF THE INVENTION

A typical exemplary residential garage has a nine foot interior ceiling comprising joists, rafters, or trusses, and comprising an immediately underlying ceiling panel consisting of "sheet rock" or gypsum ceiling board attached with screws or nails. Such garage commonly has a large garage door opening extending through a wall of the garage, such door opening commonly having dimensions approximately seven feet high and ten feet wide for a single automobile garage. Commonly, the joists, rafters, or trusses of the ceiling of the garage extend perpendicularly from the front wall which includes the door opening, and such joists, rafters, or trusses are commonly arranged twenty-four inches apart "on center."

Garage door roller tracks are typically mounted upon such garage wall, the roller tracks extending upwardly along the lateral inner edges of the garage door opening to the top of the opening, the roller tracks thence arcuately curving upwardly and inwardly forming arms extending into the interior space of the garage a distance approximately equal to the height of the garage door opening. Metal hanger brackets are typically lag bolted to the wooden frame members of the garage ceiling, such hanger brackets typically extending downwardly to interconnect with and rigidly support the inwardly extending arms of the roller tracks. A laterally sectioned and hingedly connected garage door having a plurality of laterally extending rollers is rollably mounted upon the roller tracks for alternate overhead opening and closing of the garage door opening. Typically, a torsion spring assist system or an extension spring assist system is utilized for assistance in opening and closing the garage door.

In application of the present inventive garage overhead storage assembly to the exemplary garage and garage door described above, it may be noted that the space which underlies the garage ceiling and which overlies the garage door when opened, constitutes a particularly advantageous space for utilization for storage. Use of such space for storage advantageously takes up no wall space which is utilizable for other purposes, and takes up no floor space. Also, homeowners typically do not view such space as constituting a part of a garage's useful overhead ceiling space, since such space is surrounded by garage door apparatus as described above. Thus, such space underlying the garage ceiling and overlying the opened overhead garage door may be advantageously utilized for storage without detracting from any actual or perceived function of the garage's interior space.

In assembling the instant inventive garage overhead storage assembly within the exemplary storage space described above, three ceiling catching beams approximately ten feet long are placed within the attic space of the garage, the beams preferably comprising "2×4" boards. Such beams are necessarily positioned within the attic space so that they overlie the ceiling and so that they extend perpendicularly across the ceiling's joists, rafters, or trusses. Preferably, the ceiling catching beams are further positioned so that they overlie the garage door when opened, and so that they are spaced evenly along the joists, rafters, or trusses at approximate three and one-half foot intervals.

Each of the three ceiling catching beams necessarily has at least a first and a second tie receiving aperture extending vertically therethrough; and preferably, in the particular exemplary application, has three of such apertures therethrough. The preferred trio of tie receiving apertures are preferably spaced and positioned along the ceiling catching beams so that one aperture is centrally located, and so that the other two apertures are positioned inwardly from the ends of the beam approximately six inches. Preferably, the apertures are one inch in diameter facilitating their secure receipt of ties, preferably comprising one inch piping or tubing. One inch circular ceiling panel apertures are similarly drilled through the ceiling panel directly below the ceiling catching beam apertures, the ceiling panel apertures allowing such ties to extend vertically through both the ceiling panel and the ceiling catching beams.

Nine ties, preferably comprising lengths of economically obtained one inch steel electrical conduit, are extended through the apertures of the ceiling catching beams, and through the ceiling panel apertures. Necessarily, the lengths of such ties are fitted so that they extend downwardly through the storage space from the garage ceiling to an elevation slightly overlying the overhead garage door when opened.

Preferably, the upper end of each tie comprises a laterally extending shear pin receiving eye or aperture. Flat round washers are preferably placed over the upper ends of the ties, such washers resting upon the upper surfaces of the ceiling catching beams. Shear pins, preferably cotter pins, are transversely extended through such eyes for downward engagement with the flat washers. So configured, the cotter pin, eye, washer, and ceiling catching beam combinations serve as slide stopping means, resisting downward motion of the ties with respect to the garage ceiling.

Shelf catching beams and lower cotter pin, eye, and flat washer combinations configured substantially identically with the upper structure described above, are preferably fixedly attached to the lower ends of the ties.

A shelf, preferably comprising a plurality of "1×4" or "1×6" wooden slats or boards is preferably disposed over the shelf catching ties, the upper surfaces of such slats serving as a shelf storage surface.

Slide stopping means which may be alternately suitably utilized at the upper and lower ends of the ties include helically threaded cap and washer combinations, annularly flanged tie ends, laterally hooked tie ends, and configuration of the tie ends to include enlarged heads and feet.

Suitable alternate shelf materials comprise plywood, plastic sheets, fiberglass sheets, metal sheets, composite board sheets, fiber board sheets, and masonite board sheets.

Where the ties comprise metal tubing, plastic caps are preferably provided for protectively covering the open ends of the tubes. In order to seal any gaps between the upper ends of the ties and the ceiling panel, ceiling trim rings extending annularly around the ties are preferably provided.

Where the garage ceiling's joists, rafters, or trusses extend parallel to the garage door wall, the ceiling catching beams are necessarily re-oriented 90° so that they cross and catch the joists, rafters, or trusses.

In use of the inventive garage overhead storage assembly, various elongated articles including wooden boards may be stored upon the upper surface of the shelf without interfering with opening and closing motion of the overhead garage door. Such assembly unobtrusively utilizes for storage the space overlying such garage door.

Accordingly, it is an object of the present inventive garage overhead storage assembly to utilize space overlying an opened overhead garage door for storage of articles.

It is a further object of said invention to provide a structure and assembly which economically accomplishes such storage objective.

It is a further objective of such invention to provide structure and assembly which achieves such storage objective through use of mechanically simple components.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
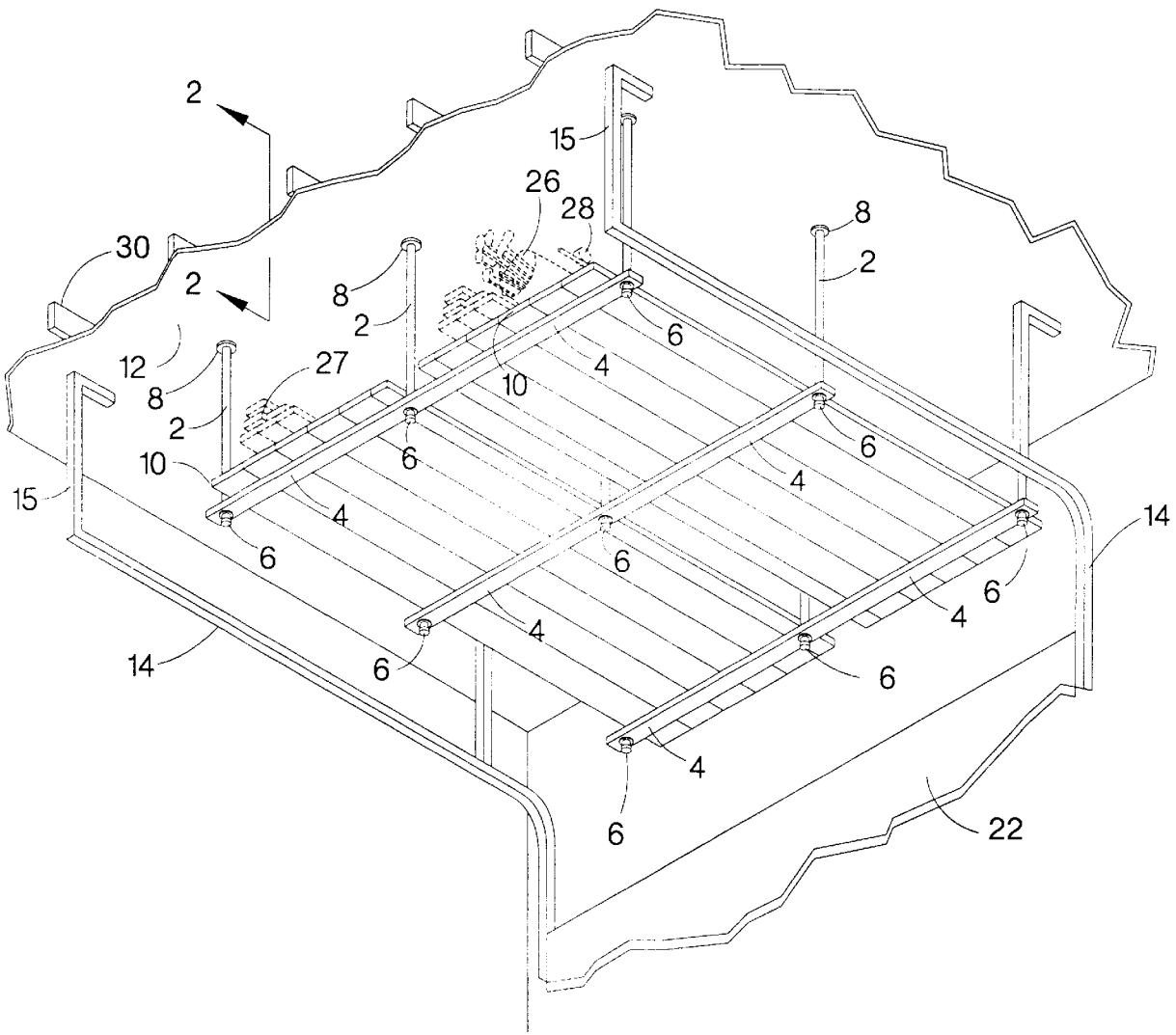
FIG. 1 is an isometric view from below of the instant inventive garage overhead storage assembly.
Figure 2:
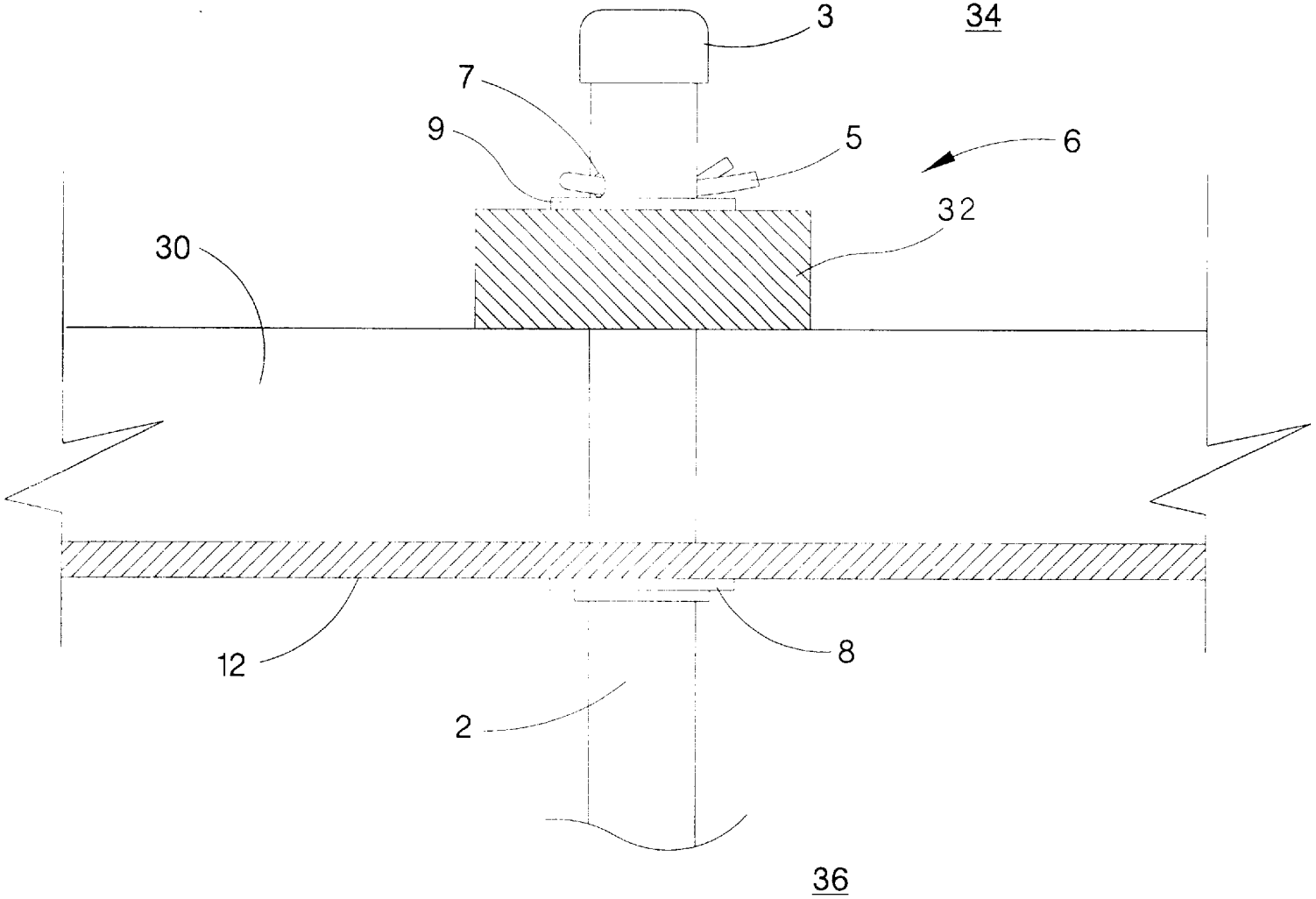
FIG. 2 is a sectional view as indicated in FIG. 1.

Referring now to the drawings, and in particular to FIG. 1, the depicted garage ceiling comprises joists, rafters, or trusses 30 having a "sheet rock" or gypsum board ceiling panel 12 fixedly attached to their lower surfaces. Referring simultaneously to FIGS. 1 and 2, the ceiling panel 12 defines an upper limit of a storage space 36, while the garage door 22, when opened, defines a lower limit of storage space 36.

Referring further simultaneously to FIGS. 1 and 2, three ceiling catching "2×4" beams 32 span perpendicularly across the upper surfaces of joists, rafters, or trusses 30, the ceiling catching beams 32 being oriented and arranged substantially identically with the orientation and arrangement of the three shelf catching beams 4.

Referring further simultaneously to FIGS. 1 and 2, ties 2 preferably comprise fitted lengths of economically obtained steel electric conduit having a one inch outside diameter. The ties 2 preferably extend upwardly through ceiling panel apertures (not depicted within view) which extend vertically through ceiling panel 12, and through upper ceiling catching beam apertures (not depicted within view) extending vertically through the ceiling catching beams 32.

Referring to FIG. 2, slide stopping assemblies referred to generally by Reference Arrow 6 preferably comprise flat round washers 9, transversely extending apertures or eyes 7, and shear pins 5. Upon application of a downward pulling force to ties 2, the walls of eyes 7 compress against upper surfaces of pins 5, causing pins 5 to engage flat washers 9, driving washers 9 against the upper surfaces of ceiling catching beams 32, and driving ceiling catching beams 32 against the upper surfaces of the joists, rafters, or trusses 30, such mechanical linkage preventing downward movement of tie 2. The shear pins 5 preferably comprise cotter pins, promoting economy, and ease of assembly and disassembly. Referring simultaneously to FIGS. 1 and 2, each of the upper ends of ties 2 depicted in FIG. 1 are preferably secured by slide stopping means which are preferably configured similarly with the assembly depicted in FIG. 2.

Referring further simultaneously to FIGS. 1 and 2, three lower shelf catching beams 4 held by slide stops 6 are preferably configured substantially identically to the ceiling catching beams 32 and the slide stop assemblies 6 depicted in FIG. 2. Preferably, plastic end caps 3 protectively cover and seal the upper and lower ends of each of the conduit pipe ties 2. Ceiling trim rings 8 are also preferably provided for spanning and aesthetically covering any gaps between the ceiling panel apertures and the ties 2.

Referring to FIG. 1, a shelf panel preferably comprising "1×4" or "1×6" boards 10 overlies and is supported by shelf catching beams 4, the upper surfaces of the shelf panel functioning as a storage area. Boards 27, golf clubs 26, and fishing pole 28 drawn in ghost are examples of items which may be conveniently stored upon the shelf panel.

Referring further to FIG. 1, the inventive garage overhead storage assembly is necessarily positioned between track hanger brackets 15, and between the inwardly extending arms of garage door roller tracks 14. Necessarily, the assembly extends downwardly from ceiling panel 12 to an elevation slightly above the elevation of roller tracks 14. Referring simultaneously to FIGS. 1 and 2, such orientation of the storage assembly allows garage door 22 to upwardly raise and inwardly travel to underlie storage space 36 without contacting any structural element of the storage assembly.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A storage assembly comprising:

(a) a storage space underlying a garage ceiling and overlying an opened overhead garage door, the garage ceiling comprising a ceiling panel and a plurality of rafters, joists, or trusses, the ceiling panel being fixedly attached to the rafters, joists, or trusses, the ceiling panel having a plurality of ceiling apertures therethrough;

(b) a plurality of ceiling catching beams, each having at least a first and a second upper tie receiving aperture therethrough, each ceiling catching beam overlying at least a first and a second rafter, joist, or truss among the plurality of rafters, joists, or trusses;

(c) a plurality of ties, each having an upper and a lower end, each upper end extending through one of the ceiling apertures, each upper end further extending through one of the first and second upper tie receiving apertures;

(d) a plurality of upper slide stops fixedly attached to the upper ends of the ties, the upper slide stops being adapted for resisting downward movement of the ties through the upper tie receiving apertures;

(e) a plurality of shelf catching beams, each having at least a first and a second lower tie receiving aperture therethrough, the lower end of each tie extending through one of the first and second lower tie receiving apertures;

(f) a plurality of lower slide stops fixedly attached to the lower ends of the ties, the lower slide stops being adapted for resisting downward motion of the shelf catching beams; and (g) a shelf panel overlying the shelf catching beams, the lower ends of the ties overlying the opened overhead garage door.

2. The storage assembly of claim 1 wherein the ceiling catching beams extend substantially perpendicularly across the rafters, joists, or trusses.

3. The storage assembly of claim 2 wherein the ties comprise metal tubes.

4. The storage assembly of claim 3 further comprising a plurality of plastic caps covering the ends of the metal tubes.

5. The storage assembly of claim 4 further comprising a plurality of ceiling trim rings, each extending annularly around one of the metal tubes.

6. The storage assembly of claim 3 wherein the upper and lower slide stops comprise cotter pin, eye, and washer combinations.

7. The storage assembly of claim 6 wherein the shelf panel comprises a plurality of wooden slats.

8. The storage assembly of claim 7 further comprising a plurality of plastic caps covering the ends of the metal tubes.

9. The storage assembly of claim 8 further comprising a plurality of ceiling trim rings, each extending annularly around one of the metal tubes.

10. The storage assembly of claim 2 wherein the upper and lower slide stops comprise structure selected from the group consisting of cotter pins, shear pins, helically threaded caps, annularly flanged tie ends, "L" hooks, enlarged heads, and enlarged feet.

11. The storage assembly of claim 10 wherein the shelf panel comprises structure selected from the group consisting of wooden slats, plywood sheets, metal sheets, plastic sheets, fiberglass sheets, composite board sheets, fiberboard sheets, and masonite board sheets.

12. The storage assembly of claim 11 wherein the ceiling catching beams and the shelf catching beams comprise "2×4" lumber.

* * * * *